United States Patent [19]

Mabuchi et al.

[11] 4,197,672

[45] Apr. 15, 1980

[54] MODEL RACING CAR

[75] Inventors: Kenichi Mabuchi; Tatuo Katunuma, both of Matsudo, Japan

[73] Assignee: Mabuchi Motor Co. Ltd., Tokyo, Japan

[21] Appl. No.: 962,932

[22] Filed: Nov. 22, 1978

[30] Foreign Application Priority Data

Dec. 7, 1977 [JP] Japan ..... 52-146904

[51] Int. Cl.[2] ..... A63H 30/00; A63H 31/00

[52] U.S. Cl. ..... 46/254; 46/262

[58] Field of Search ..... 46/254, 262, 255, 251, 46/263

[56] References Cited

U.S. PATENT DOCUMENTS

| | | | |
|---|---|---|---|
| 2,691,946 | 10/1954 | Marmo | 46/251 |
| 3,376,827 | 4/1968 | Slemmons | 46/251 |
| 3,590,526 | 7/1971 | Dexerl | 46/262 |
| 3,757,464 | 9/1973 | Gagnon | 46/262 |

FOREIGN PATENT DOCUMENTS

| | | | |
|---|---|---|---|
| 2809250 | 9/1978 | Fed. Rep. of Germany | 46/262 |
| 996620 | 12/1951 | France | 46/210 |
| 1525823 | 9/1978 | United Kingdom | 6/262 |

*Primary Examiner*—Russell R. Kinsey
*Assistant Examiner*—Paul J. Hirsch

[57] ABSTRACT

A model racing car having front wheels, rear wheels, drive motors and a radio control receiver and of the front drive type that is adapted to control a large steering angle of the front wheels by means of the output of the radio control receiver, wherein a plurality of the drive motors with reduction gear devices, mounted on each of the front wheels for driving the front wheels independently are caused to rotate in an interlocking fashion as a block by the output of the radio control receiver, whereby the steering angle of the front wheels is controlled.

5 Claims, 5 Drawing Figures

MODEL RACING CAR

BACKGROUND OF THE INVENTION

1. Field of the Invention

This invention relates generally to a model racing car, and more specifically to a model racing car of the front drive type that is adapted to control the steering angle of front wheels by the output of a radio control receiver wherein the left and right front wheels are independently driven by drive motors mounted on each of the front wheels through the use of reduction gear devices, and each driving block integrally constructed of the front wheels, the reduction gear device and the drive motor is controlled by the output of the radio control receiver.

2. Description of the Prior Art

In most conventional model racing cars, the so-called rear-drive, front-control system in which driving force is applied to the rear wheels and the control of the travelling direction is effected by the front wheels has usually been adopted. In a model racing car of this type, however, unwanted phenomena such as the slipping of wheels during turning or spin turns due to the slip tend to occur when it travels on a flat floor surface, particularly at high travelling speed. To prevent such phenomena, the so-called front-drive system in which both the driving direction control and the application of driving force are effected on front wheels has been devised.

In a model racing car of the front drive type, as shown in FIG. 1, left and right front wheels 1 are driven by a drive shaft 4 with a differential gear device 3 driven by a drive motor 2 through the use of a universal joint 5, and the steering angle of the front wheels 1 is controlled by a tie rod 6 controlled in the direction shown by an arrow in the FIGURE by the output of a radio control receiver (not shown). As described above, a model racing car of the conventional front-drive type has the following disadvantages in terms of the construction of drive assembly.

(1) The differential gear device 3 of a complicated mechanism is required.

(2) The use of the universal joint 5 to couple the drive shaft 4 and the front wheels 1 may cause problems in terms of the strength and wear of the universal joint 5. In addition, the limited bending angle of the universal joint 5 restricts the control range of the steering angle of the front wheels 1.

(3) The construction of the linkage (not shown) between the tie rod 6 for controlling the steering angle of the front wheels and the axle shafts of the front wheels becomes complicated.

(4) Since the construction of the drive assembly involves the use of the differential gear device 3 and the universal joint 5, a multiple number of bearings (not shown) are required on the axle shafts of the front wheels 1 and the drive shaft 4. This results in a complicated mechanism and problems such as the wear of the bearings and poor assembling accuracy.

SUMMARY OF THE INVENTION

This invention is intended to solve the aforementioned problems. It is an object of this invention to provide a model racing car of the front drive type that is adapted to control the steering angle of front wheels by means of the output of a radio control receiver, wherein the left and right front wheels are independently driven by drive motors mounted on each of the front wheels through the use of reduction gear devices, and each driving block integrally constructed of the front wheels, the reduction gear device and the drive motor is caused to rotate by the output of the radio control receiver so as to simplify the mechanism, expand the control range of the steering angle of the front wheels, and reduce the wear parts in the bearing portions.

These and other objects and advantages of the present invention will be better understood with reference to the accompanying drawings in conjunction with the detailed description of the invention.

DETAILED DESCRIPTION OF THE PREFERRED EMBODIMENT

Figure 1:
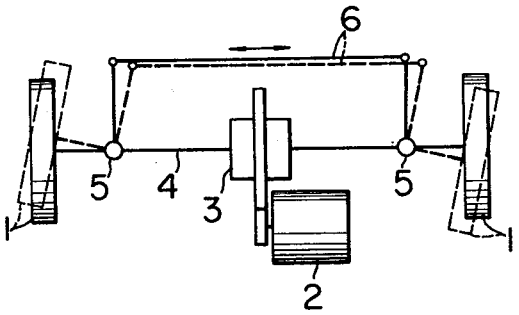
FIG. 1 is a schematic diagram illustrating the model racing car of the conventional front-drive type.
Figure 2:
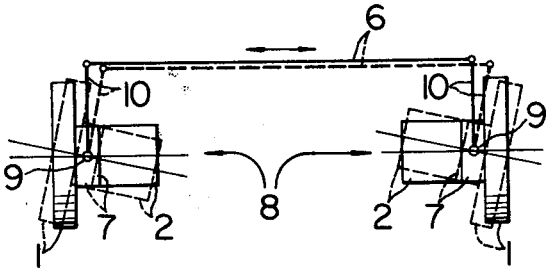
FIG. 2 is a schematic diagram illustrating a front wheel driving mechanism embodying the present invention, in comparison with FIG. 1.

FIG. 2 shows the mechanism of a front wheel driving portion embodying this invention. The mechanism will be described in the following, in comparison with the conventional driving mechanism as shown in FIG. 1. Among reference numerals used in FIG. 2, the same numerals as in FIG. 1 represent the same components.

In the figure, king pins 9 are provided above and below each of driving blocks 8 integrally constructed of front wheels 1, reduction gear device 7 and drive motors 2 in a fashion to be described later so as to rotatably support each driving block 8 on a chassis, which will be described later. The front wheel 1 and the drive motor 2 in each driving block 8 are constructed in such a manner that their rotating axes are in alignment with each other. The model racing car of this invention is caused to travel by driving each of the front wheels 1 by their respective drive motors 2 through their respective reduction gear devices 7. It is needless to say that the respective drive motors 2 are rotated at the same rotating speed to cause the car to run straightforwards. The control of the travelling direction of the model racing car is effected by the output of the radio control receiver (not shown) through a tie rod 6 moving in the direction shown by an arrow in the figure. That is, as king pin arms 10 fixed to the king pins 9 at one end and connected to the tie rod 6 at the other end are controlled by the tie rod 6 in the direction shown by an arrow in the figure, the driving block 8 fixed to the king pin arms 10 at the king pins 9 is caused to rotate horizontally around the king pins 9. Needless to say, the steering angle of the left and right front wheels 1 is the same during this operation.

Figure 3:
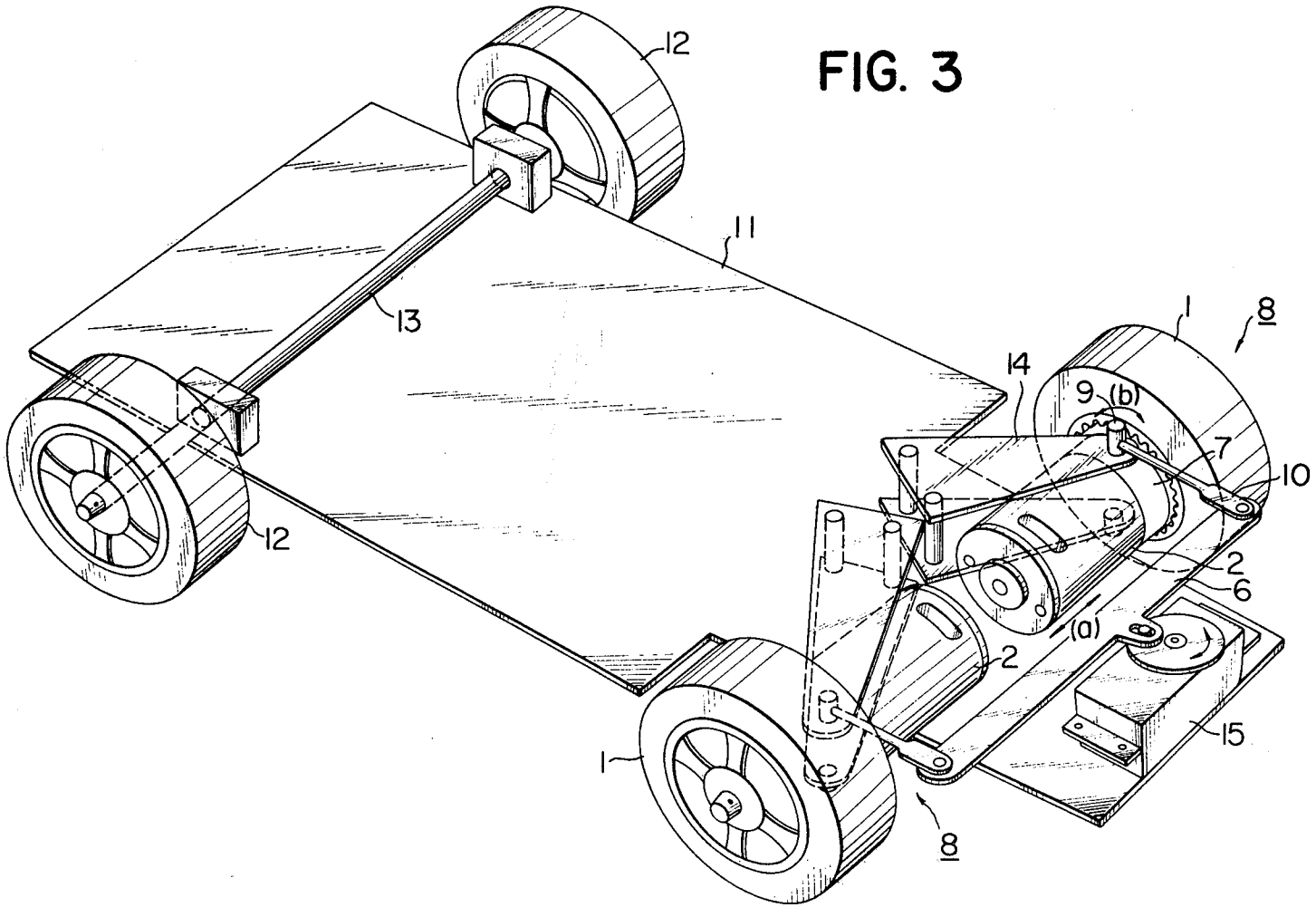
FIG. 3 is a perspective view illustrating an embodiment of this invention.

FIG. 3 is a perspective view of an embodiment of this invention equipped with the front wheel driving mechanism shown in FIG. 2. As shown in FIG 3, rear wheels are rotatably fitted to a rear wheel axle shaft 13 at the rear of the chassis 11. In front of the chassis 11, the driving blocks 8 are rotatably supported by steering arms 14 fixed to the chassis 11. In other words, each of the driving blocks 8 is horizontally rotatably supported by two steering arms 14 at the king pins 9 which are provided above and below the driving blocks 8, as shown in the figure. As described in FIG. 2, the model racing car of this invention travels by driving each of the front wheels 1 with the respective drive motors 2 via the respective reduction gear devices 7. The control of the travelling direction of the model racing car is effected by driving the tie rod 6 in the direction shown by an arrow (a) in the figure with a servo-motor 15, which is controlled by the output of the radio control receiver (not shown). In other words, the king pin arms 10 which are fixed at one end to the king pins 9 provided on the peripheral of the driving blocks 8 and connected to the tie rod 6 at the other end are rotated around the king pins 9 by the tie rod 6 in the direction shown by an arrow (b) in the figure. This causes the driving blocks 8, which are fixed to the king pin arms 10 at the king pins 9 to horizontally rotate around the king pins 9 in the direction shown by the arrow (b). When the travelling direction of the model racing car is controlled by the control of the rotating angle by the servo-motor 15, the rotation of each drive motor 2 driving each front wheel 1 is controlled in accordance with the control amount of the servo-motor 15 to facilitate smooth change in the travelling direction of the model racing car.

Figure 4:
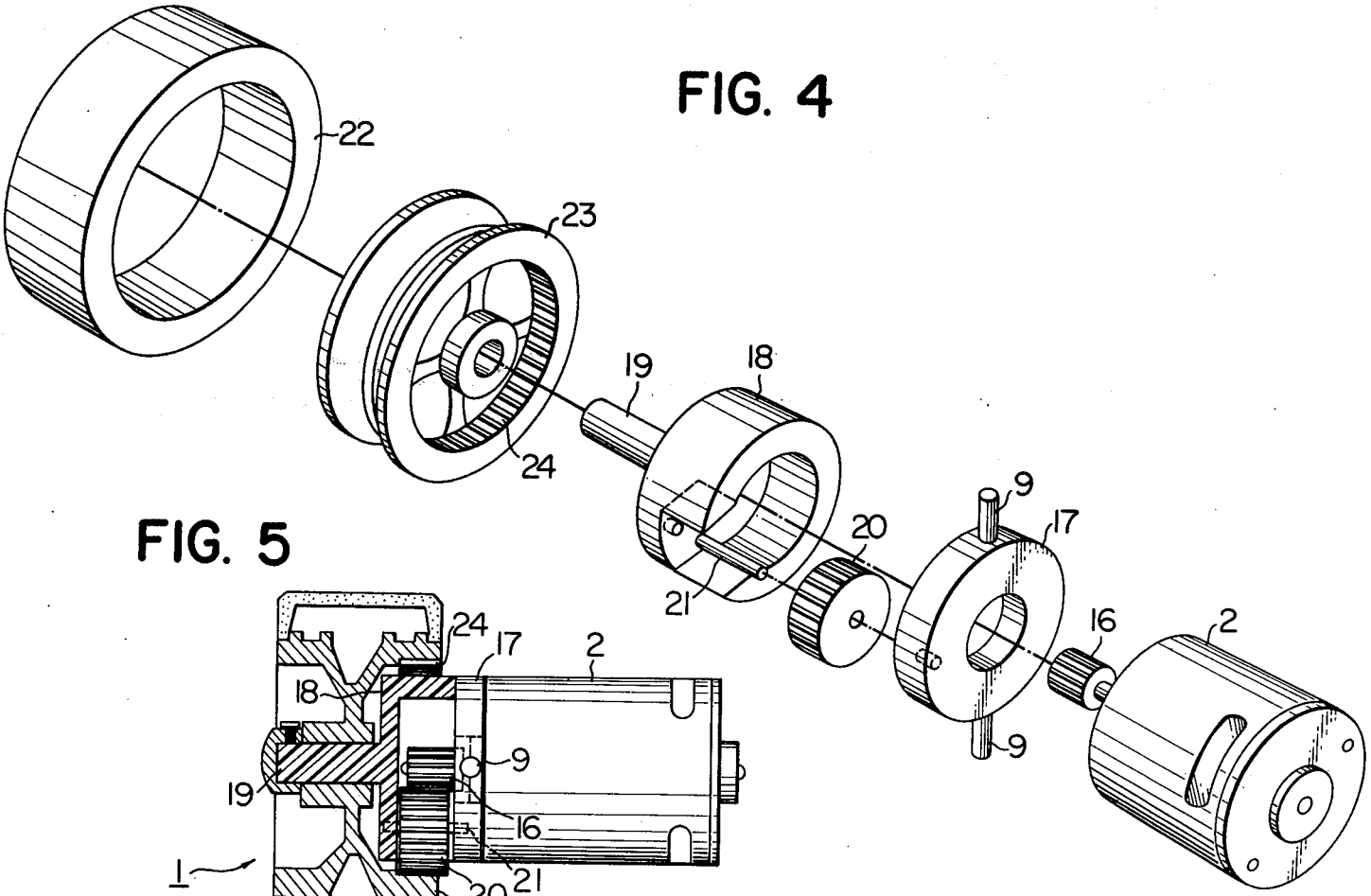
FIG. 4 is an exploded view of a driving block integrally constructed of front wheels, reduction gear devices and drive motors in FIG. 3.

Next, the driving block integrally constructed of the front wheels 1, the reduction gear device 7 and the drive motor 2 will be described with reference to FIGS. 4 and 5. In FIG. 4 showing an exploded view of the driving block 8, a pinion gear 16 is fixed to the rotating shaft of the drive motor 2. A U-cup-shaped gear box 18 is concentrically fixed to the drive motor 2 with a gear box mount 17 interposed between them. On the end face of the gear box 18 opposite to the drive motor 2, a wheel shaft 19 is integrally formed with the gear box 18, arranged in alignment with the rotating axis of the drive motor 2. In the gear box 18, an intermediate gear 20, which is in mesh with the pinion gear 16 and exposed to the outside of the gear box 18, is rotatably fixed to an intermediate gear shaft 21. A wheel assembly consisting of a type 22 and a wheel 23 on the internal circumference of which a gear 24 is formed is rotatably fitted to the wheel shaft 19 with the gear 24 in mesh with the intermediate gear 20. The driving block 8 assembled in this manner is shown in FIG. 5.

Figure 5:
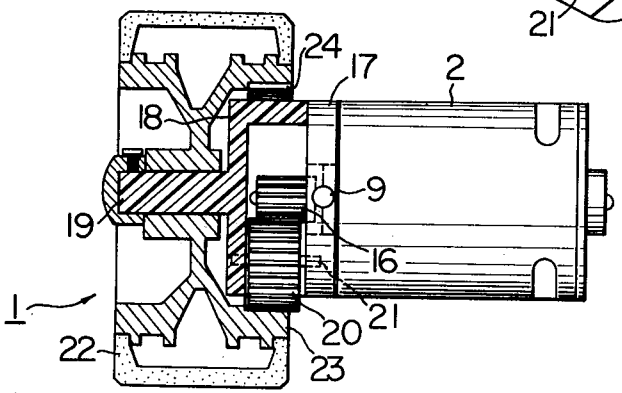
FIG. 5 is an assembly diagram of the driving block.

As shown in FIG. 5, the front wheel 1 and the drive motor in the driving block 8 are concentrically constructed, and the drive motor 2 drives the front wheel 1 through the pinion gear 16, the intermediate gear 20 and the gear 24 formed on the internal circumference of the wheel 23. On the external circumference of the gear box mount 17, two king pins 9 are integrally formed with the gear box mount 17 almost symmetrically with respect to the center of the gear box mount 17. The driving block 8 is rotatably supported by the steering arms 14 at the king pins 9. Although it has been described above that the king pins 9 are positioned almost symmetrically with respect to the center of the gear box mount 17, in the actual design, the relative location of the king pins 9 is slightly shifted in parallel with the axis of symmetry to provide a caster angle so as to automatically maintain the steering angle of the front wheel 1 in a straight drive state when the steering control by the servo-motor 15 is nil. The shift distance of the king pins 9, which varies depending on the component specifications of the model racing car, is a value to be determined in the design stage.

As described above, this invention makes it possible to provide a model racing car of the front drive type adapted to control the steering angle of the front wheels by the output of the radio control receiver which has a simplified drive and travelling direction control mechanism, as compared with the conventional model racing car. Furthermore, this invention makes it possible to provide a model racing car having less wear parts such as bearings, an expanded control range of steering angle and stable travelling performances.

What is claimed is:

1. A model racing car having front wheels, rear wheels, drive motors and a radio control receiver, the drive motors driving the front wheels and the steering angle of the front wheels being controlled by the output of the radio control receiver, characterized in that the drive motors, together with reduction gear devices, are mounted independently on each of the front wheels, the steering angle being controlled by rotating in an interlocking fashion a plurality of front wheel blocks by means of the output of the radio control receiver, each of the blocks comprising the front wheel, the reduction gear device and the drive motor as one block.

2. The model racing car as set forth in claim 1 characterized in that king pins are provided on each of the front wheel blocks and steering arms are coupled to the chassis, each of the front wheel blocks being rotatably supported about the king pins by said steering arms.

3. The model racing car as set forth in claim 1 characterized in that the steering angles of the wheels in each of the front wheel blocks are controlled simultaneously and at the same angle by means of a rotating mechanism fixed to the king pins and controlled by the output of the radio control receiver.

4. The model racing car as set forth in claim 1 characterized in that the front wheel block is constructed so that the axle shaft of the front wheel is in alignment with the rotating axis of the drive motor with the reduction gear device interposed in between.

5. The model racing car as set forth in claim 1 characterized in that the front wheel block is constructed so that a pinion gear is fixed to the rotating shaft of the drive motor, a gear box supporting an intermediate gear which is in mesh with the pinion gear and exposed to the outside of the gear box in fixed relation to the drive motor, a wheel shaft is integrally formed with the gear box on the outer surface of the end face of the gear box in axial alignment with the rotating shaft of the drive motor, and a wheel having gear teeth formed on the internal circumference of the wheel and in mesh with the intermediate gear is rotatably fitted to the wheel shaft.

* * * * *